United States Patent [19]

Onoue

[11] 4,124,939

[45] Nov. 14, 1978

[54] FOLDING KNIVES

[76] Inventor: Takuo Onoue, 12-14-335, Oike 1-Chome, Ibaragi-shi, Osaka-fu, Japan

[21] Appl. No.: 817,619

[22] Filed: Jul. 21, 1977

[51] Int. Cl.[2] ..... B26B 1/04
[52] U.S. Cl. ..... 30/161
[58] Field of Search ..... 30/160, 161

[56] References Cited

U.S. PATENT DOCUMENTS

| | | | |
|---|---|---|---|
| 868,179 | 10/1907 | Griswold | 30/161 |
| 1,373,993 | 4/1921 | Boe | 30/161 |
| 2,728,984 | 1/1956 | Hopta | 30/161 |

FOREIGN PATENT DOCUMENTS

| | | | |
|---|---|---|---|
| 1,043,285 | 10/1953 | France | 30/161 |

*Primary Examiner*—Jimmy C. Peters
*Attorney, Agent, or Firm*—Robert E. Burns; Emmanuel J. Lobato; Bruce L. Adams

[57] ABSTRACT

In a folding knife, a blade outfolded from the handle is reliably fixed with respect to the handle during use but is infolded by turning a releasing lever after use. The knife comprises a blade which is foldably mounted on a handle, a resilient lock bar which is pivotably mounted on the handle so that it engages with or disengages from the tang of the blade, and a releasing lever which is turned in the direction opposite to the direction, in which the handle is gripped, to release the engagement of the blade tang with the lock bar.

4 Claims, 14 Drawing Figures

FOLDING KNIVES

BACKGROUND OF THE INVENTION

This invention relates to folding knives.

In conventional forms of folding knife, the outfolded blade is often shut during use, inflicting a wound on the fingers which are holding the knife.

To eliminate this drawback, various forms of knife are provided. In one form, a leaf spring is assembled in the back of the handle so that the reversal of the outfolded blade is prevented by the elastic force of the leaf spring. In another construction, a spring is mounted inside the handle at its rear end and a lock bar for receiving the elastic force of the spring is pivotably mounted at the back of the handle so that the tang of the outfolded blade is held by one end of the lock bar upon receiving the elastic force of the spring to prevent the reversal of the blade.

In the former construction, however, the range of vertical movement of the leaf spring is rather limited because it is mounted at the back of the knife. Accordingly, the engagement between the blade tang and the tip of the leaf spring becomes smaller, urging easily the blade to the shut position when a force acting in the direction in which the blade is infolded is applied to the back of the blade or the lock bar. If the elasticity of the leaf spring is increased to prevent the above-mentioned drawback, it becomes difficult to release the engagement of the leaf spring with the blade.

In the latter construction, the point where a pressure is applied with respect to the lock bar at the time of releasing the engagement between the blade and the lock bar is a dent provided at the back of the handle in the rear. Furthermore, the direction in which the lock bar is applied with a pressure for disengagement from the blade tang is the same as the direction in which the handle is grasped. When the handle is grasped during use, therefore, the rear portion of the palm often depresses the rear end of the lock bar at the dent, overcoming the elasticity of the leaf spring, causing the lock bar to move whereby the blade is urged to the shut position. This drawback can be eliminated by increasing the elasticity of the leaf spring. If this method is employed, however, disengagement of the lock bar becomes difficult. To increase the depth of the engagement between the blade and the lock bar, the range of vertical movement of the lock bar must be enlarged. However, this range is limited because of the size of the knife. In addition, as a leaf spring is mounted in the back of the handle, the overall size of knife is increased.

SUMMARY OF THE INVENTION

The first object of the invention is to prevent the reversal of a blade outfolded from a handle during use.

The second object of the invention is to maintain the blade reliably under the condition where it is not infolded during use.

The third object of the invention is to prevent injuries of the fingers holding the handle by the blade during use.

The fourth object of the invention is to release the engagement between the blade tang and the lock bar with a small force and to facilitate such releasing.

The fifth object of the invention is to provide a folding knife which makes a good appearance, is simple in construction, is easy to manufacture and can satisfy the above-mentioned four objects.

While these objects may be achieved by features of construction, improvements, combinations and operation of elements constituting the invention, the nature of the invention will be readily apparent from consideration of the following detailed description of embodiments which should be read in conjunction with the annexed drawing.

DETAILED DESCRIPTION OF THE INVENTION

Figure 1:
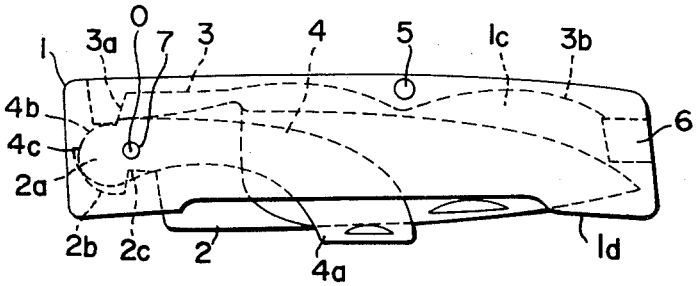
FIG. 1 is a side view of a knife according to this invention with a blade shown closed.
Figure 2:
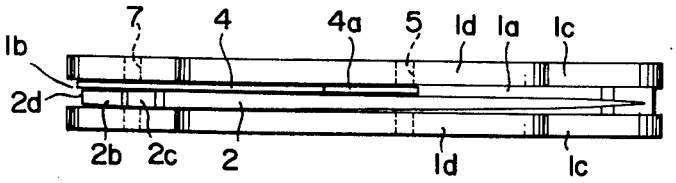
FIG. 2 is a view showing what appears in FIG. 1 as the bottom of the knife of FIG. 1.
Figure 3:
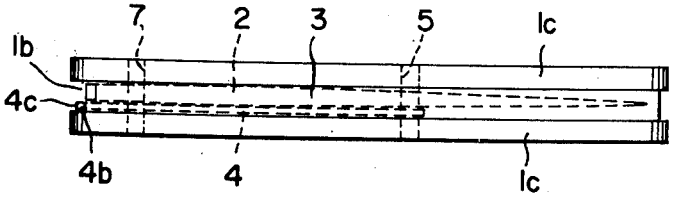
FIG. 3 is a plan view or back view of the knife.
Figure 4:
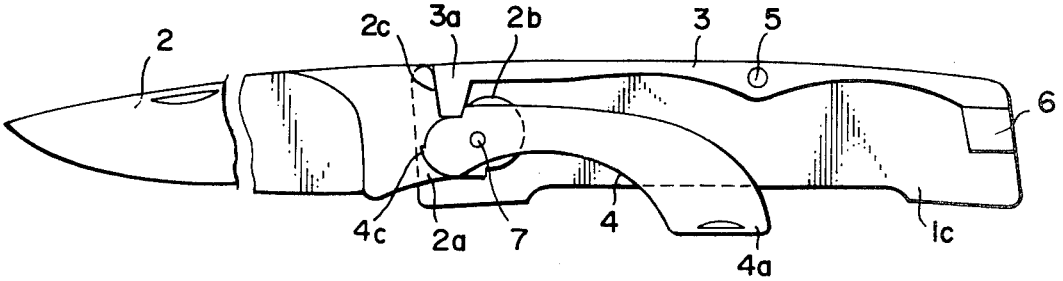
FIG. 4 is a side view with the blade shown outfolded and with one side plate removed.
Figure 5:
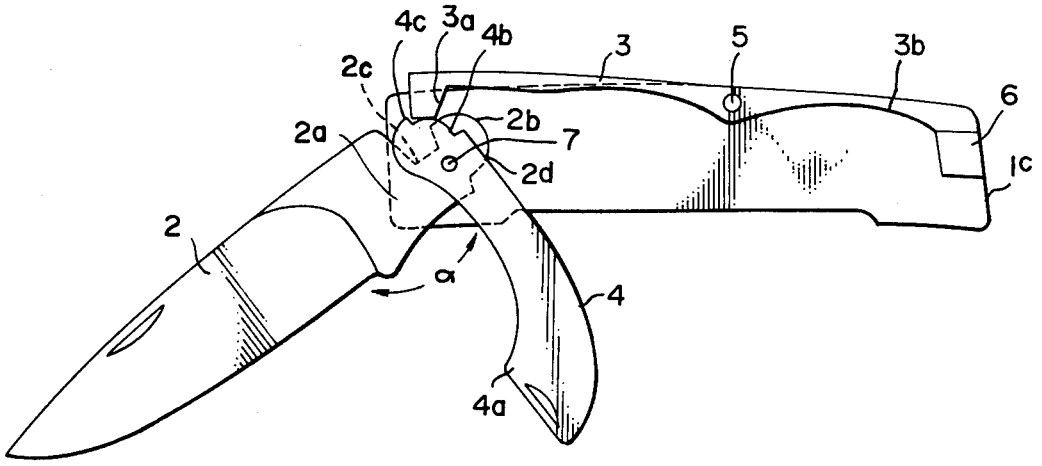
FIG. 5 is a side view showing the operating condition of the parts of the knife when the engagement between the lock bar and the blade tang as shown in FIG. 4 is released by turning the releasing lever.

A folding knife according to this invention comprises a handle 1, a blade 2 which is pivotally mounted on the handle 1, a resilient lock bar 3 which is pivotally mounted on the back of the handle 1, and a releasing lever 4 which has a pivot end pivotally mounted inside the handle 1 coaxially with the tang 2*a* of the blade 2.

The handle 1 is constructed by arranging a pair of side plates 1*c* and 1*c* oppositely with a clearance 1*b* between to form an opening 1*a*, through which the blade is outfolded or infolded, on one side. The tang 2*a* of the blade 2 is rotatably mounted on a shaft 7 at the end of the clearance 1*b* between the oppositely arranged side plates 1*c* and 1*c*. An engaging part 2*c* is formed at the upper edge 2*b* of the tang 2*a* and the rear edge 2*d* thereof is formed in a circular shape. The lock bar 3 is made of a resilient material such as spring steel which is capable of being easily deformed and recovering shape quickly. The lock bar 3 is slender and is provided, at its end, with an inwardly projecting tooth or locking part 3*a* which is engaged with or disengaged from the engaging part 2*c* of the tang 2*a*. This lock bar serves as the back of the handle 1. Namely, the lock bar is held between the side plates 1*c* and 1*c* and is fixed to the side plates 1*c* and 1*c* by a shaft 5 at its center. At the rear end of the clearance 1*b*, a stopper 6 is fixed between the side plates 1c and 1c, with which the rear end 3b of the lock bar 3 comes in contact. The releasing lever 4 is smaller in the thickness than the blade 2 and formed in a bow shape. The end edge 4b constitutes an end portion of lever 4, pivoted on pivot 7, and is formed in a circular shape so that the length R from the axis 0 of the shaft 7 is increased an inner end of the edge. Furthermore, the releasing lever 4 is arranged in parallel with the blade 2 and its end is supported by the shaft 7 together with the tang 2a so that it can be turned while keeping contact with the edge of the locking part or tooth 3a. A finger contact 4a is provided at the rear end of the releasing lever 4 projecting from the opening 1a at the center thereof, to control the turning of the releasing lever.

Figure 8:
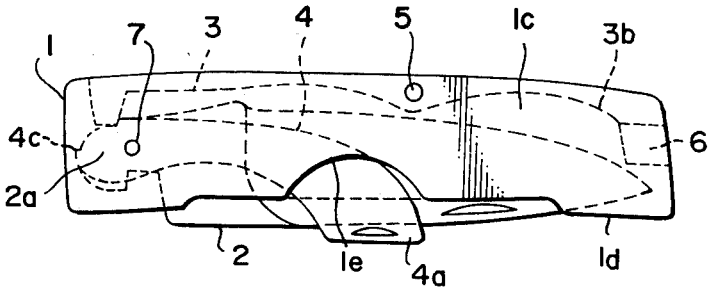
FIG. 8 is a side view of an embodiment in which a semi-circular cut is made at the edge of the side plate on the side where an opening is provided.

As shown in FIG. 8, the side plate 1c on the side where the releasing lever 4 is provided is recessed in a semi-circular shape to receive the finger contact 4a on the side where the opening 1a is formed, thereby to form the finger entrance 1e. The releasing lever 4 can be turned by putting the thumb on the rear end thereof which comes through the finger entrance 1e.

To facilitate operation of the releasing lever 4, the finger contact 4a may be provided with a nail nick or a plurality of parallel or crossed slots. A projection 4c is formed at the pivoted end 4b of the releasing lever 4. When the releasing lever 4 is turned until the projecting 4c comes into contact with the end of the tooth or locking part 3a, the tang 2a is disengaged from this locking part 3a, making it possible to know the turning angle required for the releasing lever 4 to infold the blade 2.

Previously the blade 2 has been outfolded from the handle 1 by turning it with the shaft 7 as the center. As the opening angle $\alpha$ between the handle 1 and the blade 2 was changed from acute angles to obtuse angles, the rear edge 2d of the tang 2a pushed up the locking part 3a. At that time, the lock bar 3 was supported at the handle 1 by the shaft 5 and the rear end 3b is in contact with stopper 6, thus producing resilience. When the blade 2 has been opened to a position where the opening angle becomes equal to 180°, the lock bar's tooth 3a is engaged with the engaging part 2c by virtue of the elasticity of the lock bar 3, preventing the reversal of the blade 2.

In the use of the opened knife, the user has his fingers, other than the thumb, holding the handle 1, putting them on the outside of the lower edge 1d of the side plate 1c.

In order to close the knife, the thumb is put on the finger contact 4a of the releasing lever 4, and the releasing lever is turned by it in the clockwise direction. As the releasing lever 4 is turned, the end edge 4b pushes up the locking part 3a, overcoming the elasticity of the lock bar 3. At this time, the rear end 3b of the lock bar 3 is in contact with the stopper 6, preventing the lock bar 3 from turning, and maintaining the resilience in the locking part 3a. When the locking part 3a has been disengaged from the engaging part 2c, the blade 2 can be turned in the counter-clockwise direction, and infolded into the clearance 1b through the opening 1a. Since the locking part 3a is disengaged from the engaging part 2c and the lock bar 3 is pressed against the end edge 4b of the releasing lever 4 by the resilience of the lock bar, the end of the releasing lever 4 is gradually returned to the original position with the shaft 5 as the center and is automatically infolded into the handle 1, which also receives the blade 2.

Figure 9:
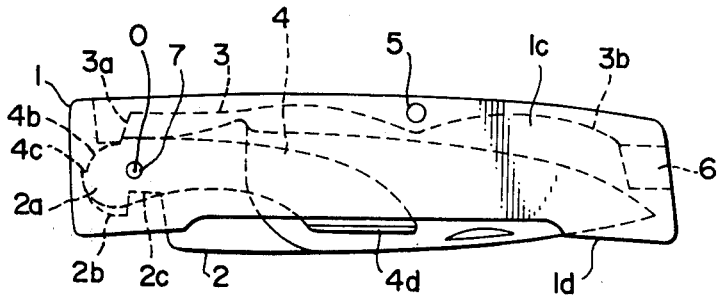
FIG. 9 is a side view of an embodiment in which a finger rest is formed by bending the rear end of the releasing lever.
Figure 10:
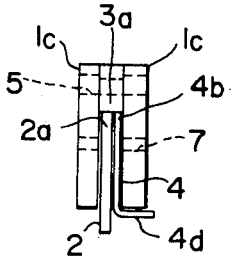
FIG. 10 is a front view of the embodiment of FIG. 9.
Figure 11:
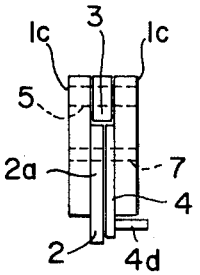
FIG. 11 is a front view of an embodiment in which a finger rest is formed by attaching a projection.

FIG. 9 shows another embodiment of the releasing lever 4. A finger rest 4d is formed by bending the rear end of the releasing lever 4 at the outside of the opening 1a to such an extent where it projects slightly from the surface of the side plate 1c, as shown in FIG. 10, or by providing a projection at the rear end as shown in FIG. 11.

When the engagement between the tang 2a and the lock bar 3 is to be released by the finger rest 4d formed at the rear end of the releasing lever 4, the finger rest 4d is situated at the center of the handle on the side where the opening 1a is provided. Accordingly, engagement can be released by putting the thumb of the hand holding the handle 1 on the finger rest 4d and by pushing the releasing lever 4 in the counter-clockwise direction. This method makes it easier to put the thumb on the finger rest 4d and facilitates the handling of the folding knife with one hand.

Figure 12:
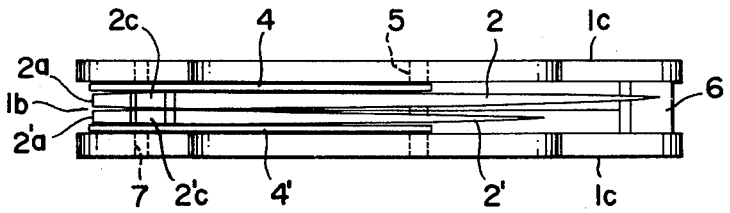
FIG. 12 is a view corresponding to FIG. 2 and showing the bottom of an embodiment in which a plurality of releasing levers are provided in a two-bladed knife.
Figure 13:
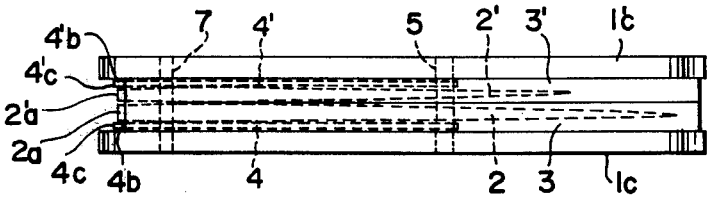
FIG. 13 is a plan view or back view of the embodiment of FIG. 12.
Figure 14:
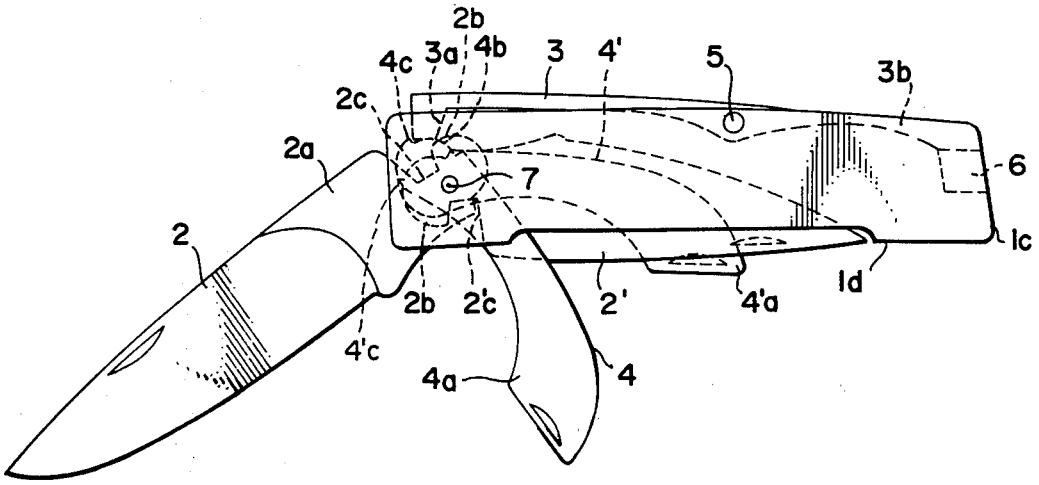
FIG. 14 is a side view showing the condition where one of the blades of the knife of FIG. 12 is being outfolded by operating one of the releasing levers.

FIGS. 12 to 14 show an embodiment in which a plurality of lock bars and releasing levers are provided in a folding knife having two blades of different lengths or widths which are rotatably mounted in parallel to each other in a handle.

Namely, in a folding knife in which two blades 2 and 2' with different lengths or widths are rotatably mounted in parallel to each other in the handle 1, two lock bars 3 and 3' are held between the side plates 1c and 1c at the back of the handle 1 and are supported on the shaft 5. The releasing levers 4 and 4' are arranged in parallel to the tangs 2a and 2a' of the blades 2 and 2' at the outside thereof and are rotatably supported by the same shaft 5 which is supporting the tangs 2a and 2a'.

As two lock bars 3 and 3' and releasing levers 4 and 4' are provided for two blades 2 and 2', the engagement of the lock bar 3 or 3' with the tang 2a or 2a of the blade 2 or 2' can be released separately by operating the respective releasing lever 4 or 4'. When releasing the engagement, the both releasing levers are turned in the direction opposite to the direction in which the grasping power of the hand holding the handle 1 is acted. Accordingly, either of the releasing levers 4 and 4' is not operated by the grasping power of the hand during the use of either of the blades, ensuring safe use of the knife at all times without injuring the hand holding the knife handle by the infolding blade during use. When the blades are to be shut, they can be infolded separately by pushing the releasing lever 4 with the thumb and turning another releasing lever 4' with the forefinger or the middle finger which are on the opposite side of the handle 1.

The advantages of this invention will now be explained.

Figure 6:
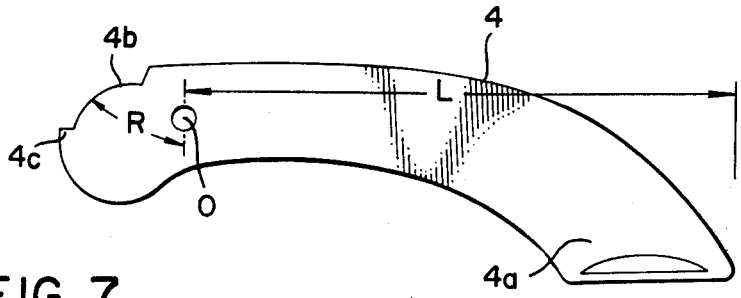
FIG. 6 is an enlarged side view of the releasing lever.
Figure 7:
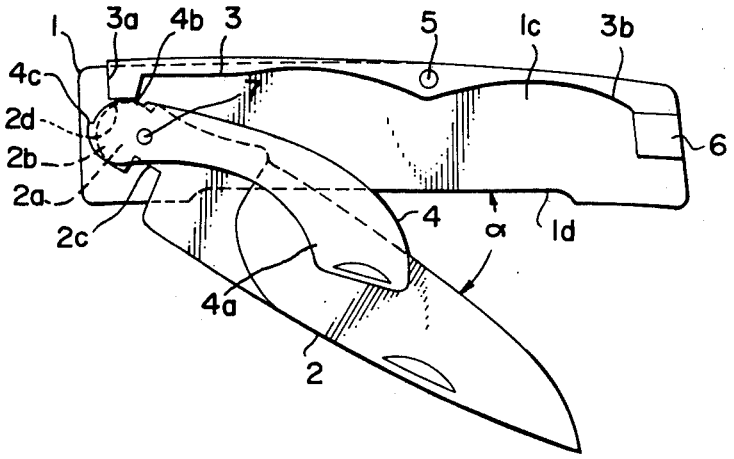
FIG. 7 is a side view showing the condition where the blade is infolded.

When the blade 2 is open from the handle 1, the locking part 3a is engaged with the engaging part 2c of the tang 2a by the resilience of the lock bar 3 and the blade 2 is fixed, thus preventing the blade 2 from being infolded. To release this condition, the lock bar 3 is not moved directly by hand but the releasing lever 4 provided separately from the lock bar 3 is turned in the direction opposite to the direction in which the handle is being grasped. Even if the handle is grasped strongly during use, therefore, the lock bar 3 will not be operated by the grasping power of the hand holding the handle 1. Accordingly, the above-mentioned engagement is reliably maintained throughout the use of the knife, thus preventing the reversal of the blade 2 to inflict a wound on the fingers holding the handle 1. As the length L (FIG. 6) of the part of the releasing lever 4 between the axis 0 of the shaft 5 and the finger contact 4*a*, which acts to push up the locking part 3*a*, is greater than the length R between the end edge 4*b* of the releasing lever 4 and the axis 0, the force required for pushing up the locking part 3*a* can be reduced based on the principle of the lever. Since the length R between the axis 0 and the edge is gradually reduced from the front end to the rear end, the locking part 3*a* is pushed down by the resilience of the lock bar 3 in case when the blade 2 is infoled as the locking part 3*a* is disengaged from the engaging part 2*c*. Thus, the resilience of the lock bar 3 is applied into the counterclockwise direction with respect to the edge through the locking part 3*a*, causing the releasing lever 4 to turn automatically with the shaft 7 as the center so that it enters the handle together with the blade 2 without requiring any special operation. Accordingly, if one hand is engaged as it is holding something during, for example, mountain-climbing or hunting, the handle 1 can be grasped with the palm of another hand and the blade 2 can be outfolded with the thumb and other fingers. Furthermore, when the engagement between the engaging part 2*c* and the locking part 3*a* at the tang 2*a* is released by turning the releasing lever 4 with the thumb of the hand holding the handle 1 and a force is applied in the counterclockwise direction by putting the back of the blade 2 on something, the blade 2 can be infolded safely by one hand. The releasing lever according to this invention can be applied to the so-called two-bladed knives having two blades mounted in parallel, or knives having two or four oppositely facing blades, assuring a high degree of safety at the time of outfolding or infolding the blades.

It is to be understood that many modifications and variations of details of construction of the folding knife according to this invention may be effected without departing from the spirit of my invention and I reserve all rights to such changes as come within the scope of this specification and the claims which follow:

What is claimed is:

1. A folding knife, comprising:

an elongate handle having a back, having an elongate longitudinal recess opening opposite the back, and having a pivot pin extending transversely through an end portion of the recess;

a blade, having a tang pivoted on the pivot pin for permitting manual folding of the blade out of and back into the recess, the handle having a resilient lock bar disposed at the back and which has, at an end of the lock bar adjacent the pivot pin, a tooth projecting into the recess, the tang of the blade having a notch disposed opposite the tooth and so shaped that the tooth fixes the blade against folding back into the recess when the blade has been entirely folded out therefrom; and a blade-releasing lever, having an end pivoted to the pin for permitting manual folding of the lever between an inner position, in the recess, and an outer position, folded out therefrom, the releasing lever having thumb contact means remote from its pivoted end for the manual folding of the lever into the outer position, and having a curved projection on its pivoted end, resiliently engaged with the lock bar's tooth for removing the tooth from the notch of the blade's tang and for thereby releasing the blade for the manual folding thereof into the recess of the handle when the blade and the releasing lever are folded out of the handle's recess;

so that in use, the blade releasing lever can be manually folded out conveniently into its outer position by engaging the thumb contact means with the thumb of the user's hand holding the handle, and the lever is automatically folded back into its inner position upon the releasing and the manual folding back of the blade, by the lock bar's tooth resiliently engaged with the release lever's curved projection.

2. A folding knife according to claim 1 in which the thumb contact means comprises a part of the releasing lever remote from its pivoted end and extending transversely of the handle.

3. A folding knife according to claim 2 in which the handle has a notch, receptive of the transversely extending part when the releasing lever is in its inner position.

4. A folding knife according to claim 1 including an additional blade having a tang pivoted on said pivot pin; and an additional releasing lever, also pivoted on said pivot pin, for releasing the additional blade, the tooth of the lock bar being removeably engageable with the tang of the additional blade separately from but similarly to the tang of the first-mentioned blade.

* * * * *